US005725056A

United States Patent [19]

Thomson

[11] Patent Number: 5,725,056

[45] Date of Patent: Mar. 10, 1998

[54] WELLHEAD ASSEMBLY WITH REMOVABLE BOWL ADAPTER

[75] Inventor: Kenneth Thomson, East Kilbride, Scotland

[73] Assignee: ABB Vetco Gray Inc., Houston, Tex.

[21] Appl. No.: 534,436

[22] Filed: Sep. 27, 1995

[51] Int. Cl.[6] ..... E21B 33/04

[52] U.S. Cl. ..... 166/382; 166/208

[58] Field of Search ..... 166/75.14, 77.51, 166/77.52, 85.3, 89.3, 208, 368, 382

[56] References Cited

U.S. PATENT DOCUMENTS 4,949,787 8/1990 Brammer et al. ..... 166/208

5,456,314 10/1995 Boehm, Jr. et al. ..... 166/208

*Primary Examiner*—William P. Neuder

*Attorney, Agent, or Firm*—James E. Bradley

[57] ABSTRACT

A wellhead assembly has provisions for emergency and nonemergency installation of oversized casing. The wellhead assembly includes a wellhead housing which has counterbore. An adapter sleeve fits within the counterbore. The adapter sleeve has an inner diameter with a profile. A casing hanger is installed during nonemergency conditions. A portion of the casing hanger seal assembly engages the inner diameter of the adapter sleeve. For an emergency when the casing hanger seal and casing hanger cannot be employed, the adapter sleeve is removed. An emergency slips is installed to support the casing. A casing hanger seal is then installed between the counterbore and casing.

25 Claims, 4 Drawing Sheets

WELLHEAD ASSEMBLY WITH REMOVABLE BOWL ADAPTER

BACKGROUND OF THE INVENTION

1.Field of the Invention

This invention relates in general to oil and gas wells, and in particular to a wellhead assembly that has an adapter for conventional casing hanger installation, the adapter being removable for emergency casing installation.

2.Description of the Prior Art

Many oil and gas wells have a wellhead housing which supports at least one string of casing, and typically several. The wellhead housing has a landing shoulder formed in the bore. A casing hanger secured to the upper end of the casing lands on the shoulder in the wellhead housing. An annular casing hanger seal seals between the casing hanger and the bore of the wellhead housing.

Occasionally, an emergency condition will occur in which the casing hanger cannot be employed. Typically, this occurs when the casing will not go completely to the bottom of the well and cannot be pulled upward. In that instance, a number of techniques exist for supporting the stuck casing under emergency conditions. Generally, this involves cutting off the casing and installing a slip assembly on the landing shoulder in the wellhead housing. The slip assembly has slips which grip the casing to support the weight of the casing. A seal is installed above the slip assembly, sealing between the wellhead housing bore and the casing.

Suitable emergency casing hanger seals and slips exist for most conditions. However, in some instances, an operator wishes to utilize oversized casing. Oversize casing is larger relative to the wellhead housing bore diameter than standard size casing. A casing hanger for oversize casing can be dimensioned so that a casing hanger seal can be installed between the casing hanger and wellhead housing. However, the annular space between the oversize casing and the wellhead bore is narrower than in conventional installations. This narrow space may not be sufficiently wide to accommodate an emergency slip hanger and seal.

SUMMARY OF THE INVENTION

The wellhead assembly of this invention will accommodate oversized casing both under nonemergency conditions and emergency conditions. The wellhead housing has a counterbore of larger diameter. An adapter sleeve locates in the counterbore for nonemergency conditions. The adapter sleeve has an interior profile which receives at least a portion of the casing hanger seal assembly.

In the event of an emergency, the adapter sleeve is removed. An emergency slip assembly is located in the counterbore instead of the adapter sleeve. The slips grip the wall of the casing. An emergency seal seals between the counterbore and the casing. In one embodiment, the adapter sleeve has a landing shoulder which supports the weight of the casing. In that embodiment, the seal assembly locates entirely between the adapter sleeve and the casing hanger. In another embodiment, the profile in the interior of the adapter sleeve includes only a locking groove. The locking groove receives a locking ring which holds the casing hanger seal in the set position. In that embodiment, the casing hanger seal seals below the adapter sleeve between the bore of the wellhead housing and the casing hanger.

Preferably, there are at least two wellhead housings mounted one on another, each supporting a string of casing. The adapter sleeve from the lower wellhead housing protrudes upward into a counterbore of the upper wellhead housing. Upper and lower seals are mounted on the outer diameter of the adapter sleeve to seal a transition area between the upper and lower wellhead housings.

The emergency seal assembly includes a transition member which is positioned between the counterbores of the upper and lower wellhead housings, above the slips assembly. The emergency casing hanger seal seals between this transition member and the casing. The transition member has seals on its upper and lower ends for sealing its outer diameter to the upper and lower wellhead housings.

DETAILED DESCRIPTION OF THE INVENTION

Figure 1:
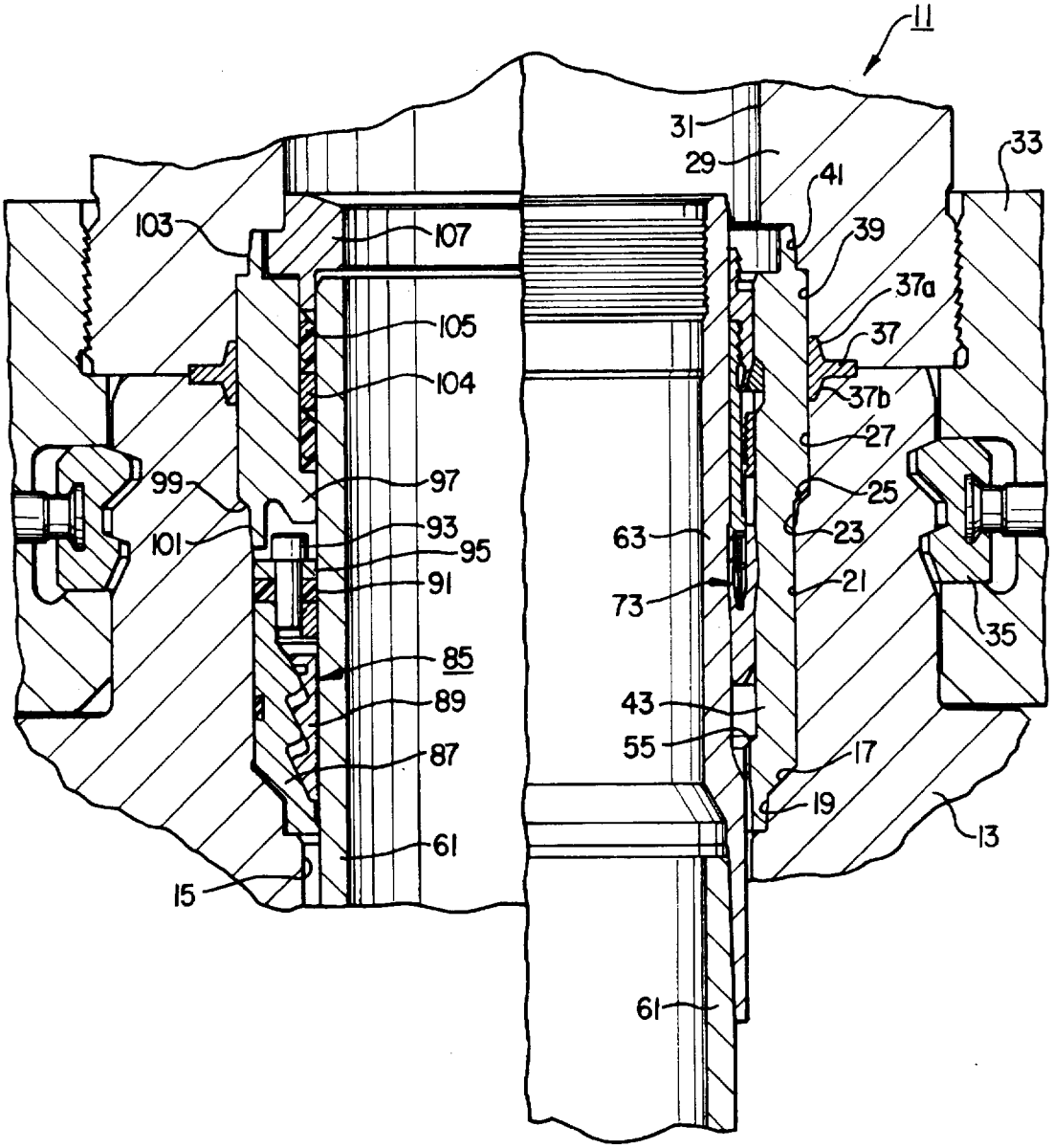
FIG. 1 is a sectional view of a first embodiment of a wellhead assembly constructed in accordance with this invention, with the right-hand showing a nonemergency installation and the left-hand showing an emergency installation.

Referring to FIG. 1, wellhead assembly 11 includes a wellhead housing, which will be referred to as lower wellhead housing 13. Lower wellhead housing 13 mounts on top of a wellhead (not shown) which supports a string of conductor pipe and a string of outer casing. A bore 15 extends axially through lower wellhead housing 13. Bore 15 has a conical upward and inward facing adapter shoulder 17. A conical seal surface 19 extends downward from adapter shoulder 17. Seal surface 19 is a tapered area, but at a much smaller angle relative to the axis then adapter shoulder 17.

A counterbore 21 comprising an area of larger diameter extends upward from adapter shoulder 17. An upper seal surface 23 is located in counterbore 21. Seal surface 23 is a tapered seal area, having the same taper as lower seal surface 19. A shoulder 25 extends from upper seal surface 23 to an upper portion 27 of counterbore 21. Upper counterbore portion 27 extends to the upper end or rim of lower wellhead housing 13 and has a larger diameter than the lower portion of counterbore 21 below shoulder 25.

Another wellhead housing, referred to as upper wellhead housing 29, is connected to the upper end of lower wellhead housing 13. Upper wellhead housing 29 also has a bore 31 which is coaxial with bore 19. A conventional connector 33 connects lower wellhead housing 13 with upper wellhead housing 29. Connector 33 employs clamping elements 35 to engage grooves on the exterior of lower wellhead housing 13 to secure the upper and lower wellhead housings 29, 13 together. A conventional seal 37 locates at the junction of the lower end of upper wellhead housing 29 and the upper end of lower wellhead housing 13. Seal 37 has upper and lower outward facing tapered flanges 37*a*, 37*b* which engage seal areas in the upper wellhead housing 29 and lower wellhead housing 13.

Upper wellhead housing 29 has a lower counterbore 39. Counterbore 39 extends to the lower end of upper wellhead housing 29 and is of the same diameter as the upper portion 27 of counterbore 21. A tapered seal surface 41 is located at the upper end of counterbore 39.

Figure 2:
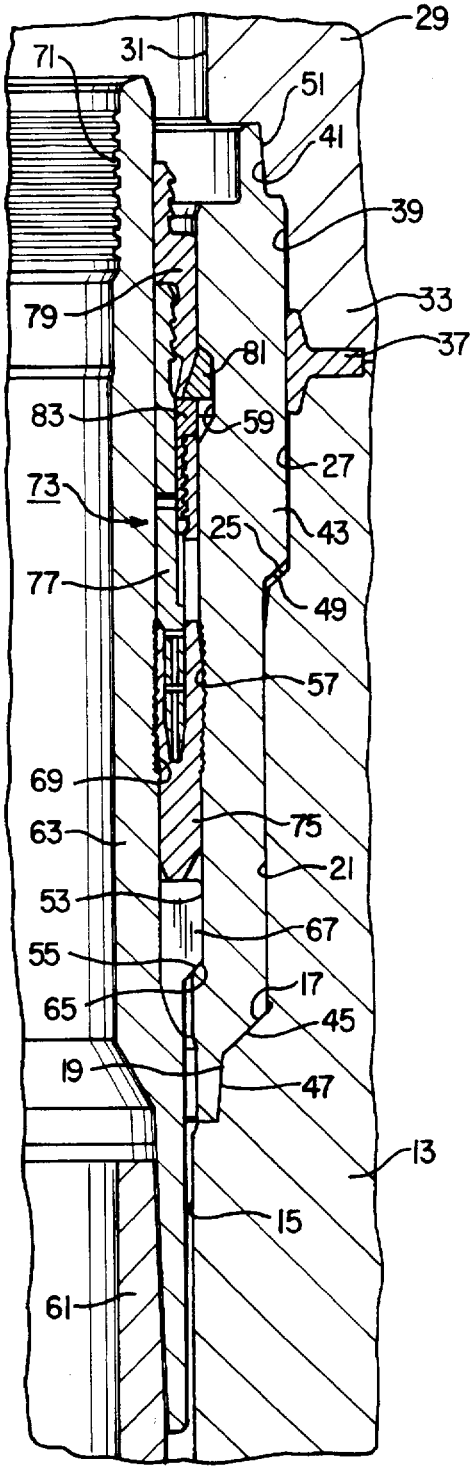
FIG. 2 is an enlarged sectional view of a portion of the right-hand side of the wellhead assembly shown in FIG. 1.

For nonemergency usage, an adapter sleeve 43 will be positioned in counterbores 21 and 39. Adapter sleeve 43 is a tubular member which is shown in larger detail in FIG. 2. A landing shoulder 45 lands on lower wellhead housing adapter shoulder 17. A lower seal 47 extends downward from landing shoulder 45 and sealingly engages lower seal surface 19 in metal-to-metal contact. Adapter sleeve 43 has an upper shoulder 49 which is located adjacent counterbore shoulder 25, but does not touch. The seal area 21 is not used with adapter sleeve 43. Adapter sleeve 43 extends upward, snugly fitting in upper counterbore portion 27 and counterbore 39 of upper wellhead housing 29. An upper integral seal 51 on adapter sleeve 43 sealingly engages seal surface 41 in metal-to-metal contact. The inner diameter of seal 37 does not seal against the outer diameter of adapter sleeve 43.

Adapter sleeve 43 has an inner diameter or profile 53 which has an internal landing shoulder 55 that faces upward and inward. A set of wickers 57 are located above landing shoulder 55. Wickers 57 comprise parallel small grooves in the preferred embodiment. A locking groove 59 extends circumferentially around inner diameter 53 above wickers 57.

A string of casing 61 is located within the well, extending through conductor pipe and outer casing (not shown) to a greater depth. Casing 61 is secured to a casing hanger 63. In the embodiment shown, casing 61 is oversized for the particular diameter of wellhead housing bore 15. The inner diameter of casing 61 is the same as the inner diameter of casing hanger 63. Casing hanger 63 has an external shoulder 65 which lands on internal landing shoulder 55 of adapter sleeve 43. A plurality of vertical flow channels 67 extend through shoulder 65 for allowing the return of well fluids during cementing operations. A set of wickers 69 is formed on the exterior of casing hanger 63 directly across from wickers 57. The outer diameter of casing hanger 63 is considerably smaller than the inner diameter of adapter sleeve 43, resulting in an annular space. Threads 71 on the upper end are used for engagement with a running tool to run casing hanger 63 and casing 61.

A conventional casing hanger seal assembly 73 locates within the annular space between casing hanger 63 and adapter sleeve 43. Casing hanger seal assembly 73 may be of a variety of types. In the embodiment shown, it includes a metal-to-metal seal 75. A central cavity in seal 75 receives an energizing member 77 for deforming inner and outer portions of seal 75 into sealing engagement with wickers 57, 69. A reacting ring 79 is secured to the upper end of energizing member 77 and to a running tool (not shown) during the running procedure. A lock ring 81 is pressed outward into lock groove 59 by reacting ring 79 when the running tool moves energizing member 77 downward to set seal 75. Reacting ring 79 and lock ring 81 stop when contacting a retainer ring 83 located on the upper end of a portion of seal 75.

To install the assembly as shown on the right-hand side of the embodiment of FIG. 1, the operator preferably makes up the lower wellhead housing 13 and upper wellhead housing 29 along with seal 37 and adapter sleeve 43, prior to installing the wellhead housings 13, 29 on the wellhead. The operator then installs the wellhead assembly 11 and drills to a selected depth for installing casing 61. The operator runs casing 61 conventionally with casing hanger 63 and a running tool. External shoulder 65 will land on internal shoulder 55, supporting the weight of casing 61. The operator then pumps cement down the casing hanger 63, which flows back up around casing 61 to cement casing 61 in place.

The casing running tool may carry seal assembly 73 in an upper position, or seal assembly 73 may be installed later with a separate tool. Seal assembly 73 is positioned between casing hanger 63 and adapter sleeve 43, then energizing ring 77 is moved downward with the running tool. This movement sets seal 75, and at the same time, reacting ring 79 wedges lock ring 81 out into lock groove 59 to lock the casing hanger seal assembly 73 in place. Seal 37 and seals 47 and 51 form a dual barrier to atmosphere. The shoulder at the upper end of seal surface 41 retains adapter sleeve 43 against upward movement due to internal pressure.

If an emergency condition exists wherein casing 61 sticks and cannot be lowered so that casing hanger 63 can land on shoulder 55, then the operator will remove casing hanger 63. The operator will remove upper wellhead housing 29 and remove adapter sleeve 43. The counterbore 21 presents an adequate annular area for installing an emergency slip hanger 85, as shown on the left side of FIG. 1.

Emergency slip hanger 85 may be of a variety of conventional types. The emergency slip hanger 85 shown has a bowl 87 which lands on adapter shoulder 17 at the lower end of counterbore 21. A plurality of slips 89 are carried on tapered surfaces in the interior of bowl 87. In the embodiment shown, a seal 91 seals between counterbore 21 and casing 85. Seal 91 is set by tightening bolts 93 against compression plate 95.

After setting slip hanger 85, a transition member 97 is placed in upper counterbore portion 27. Transition member 97 is part of the emergency casing hanger seal assembly and comprises a cylindrical member having an external landing shoulder 99 that lands on landing shoulder 25. A lower seal 101 integrally formed with transition shoulder 97 sealingly engages seal area 23 in metal-to-metal contact. Transition member 97 protrudes above the upper end of lower wellhead housing 13. An upper integral seal 103 on the upper end of transition member 97 sealingly engages seal surface 41 in metal-to-metal contact.

Transition member 97 has an internal annular recess 104 with an upward facing shoulder at the lower end. A casing seal 105 locates within the annular recess 104. A setting ring 107 acts downward on casing seal 105 to set it between transition member 97 and casing 61. Setting ring 107 is moved downward when upper wellhead housing 29 is being reconnected to lower wellhead housing 13.

In the operation of the embodiment on the left-hand side of FIG. 1, after adapter sleeve 43 has been removed, the operator will position slip assembly 85 around casing 61, while holding tension on casing 61. Slips 89 are hinged to allow placement around casing 61. The operator sets seal 91 with bolts 93, then cuts off casing 61 at a point a short distance above lower wellhead housing 13.

Then operator then installs transition member 97, placing seal 105 within the inner recess 104 of transition member 97. The operator connects upper wellhead housing 29, with setting ring 107 setting seal 105. For low pressure applications, seal 91 could serve as a primary seal. In the application shown, seal 91 allows testing of the metal seal 101 and casing seal 105 by enabling test pressure to be applied between seal 91 and seals 101, 105. Seals 101, 103 and seal 37 provide a dual barrier to atmosphere.

Figure 3:
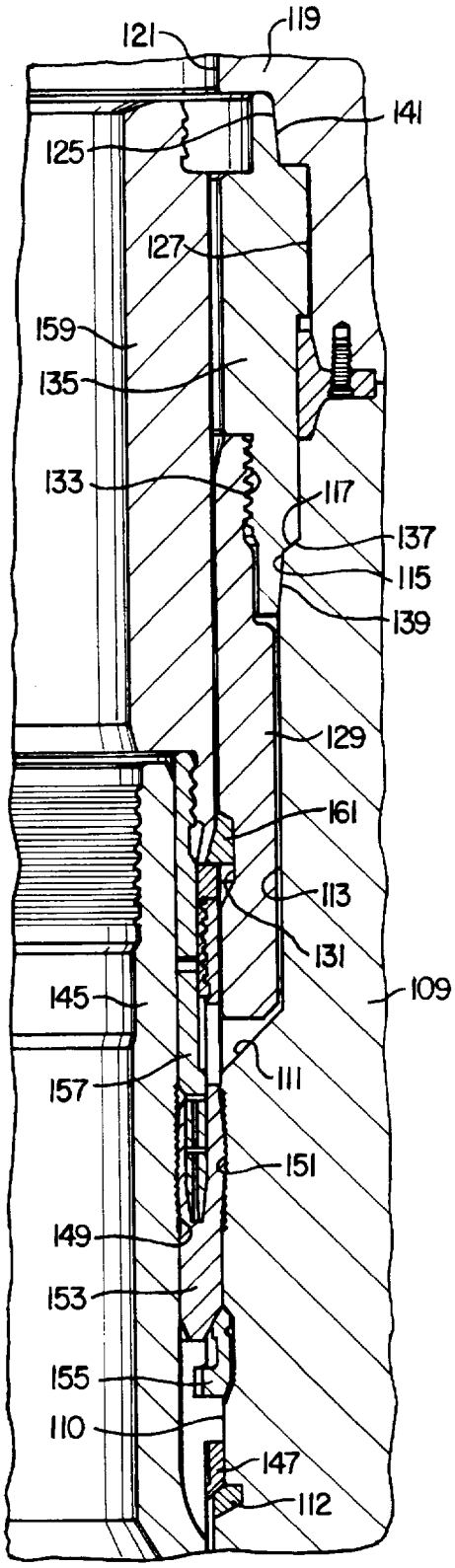
FIG. 3 is an enlarged sectional view of an alternate embodiment of a wellhead assembly, showing an installation during nonemergency conditions.
Figure 4:
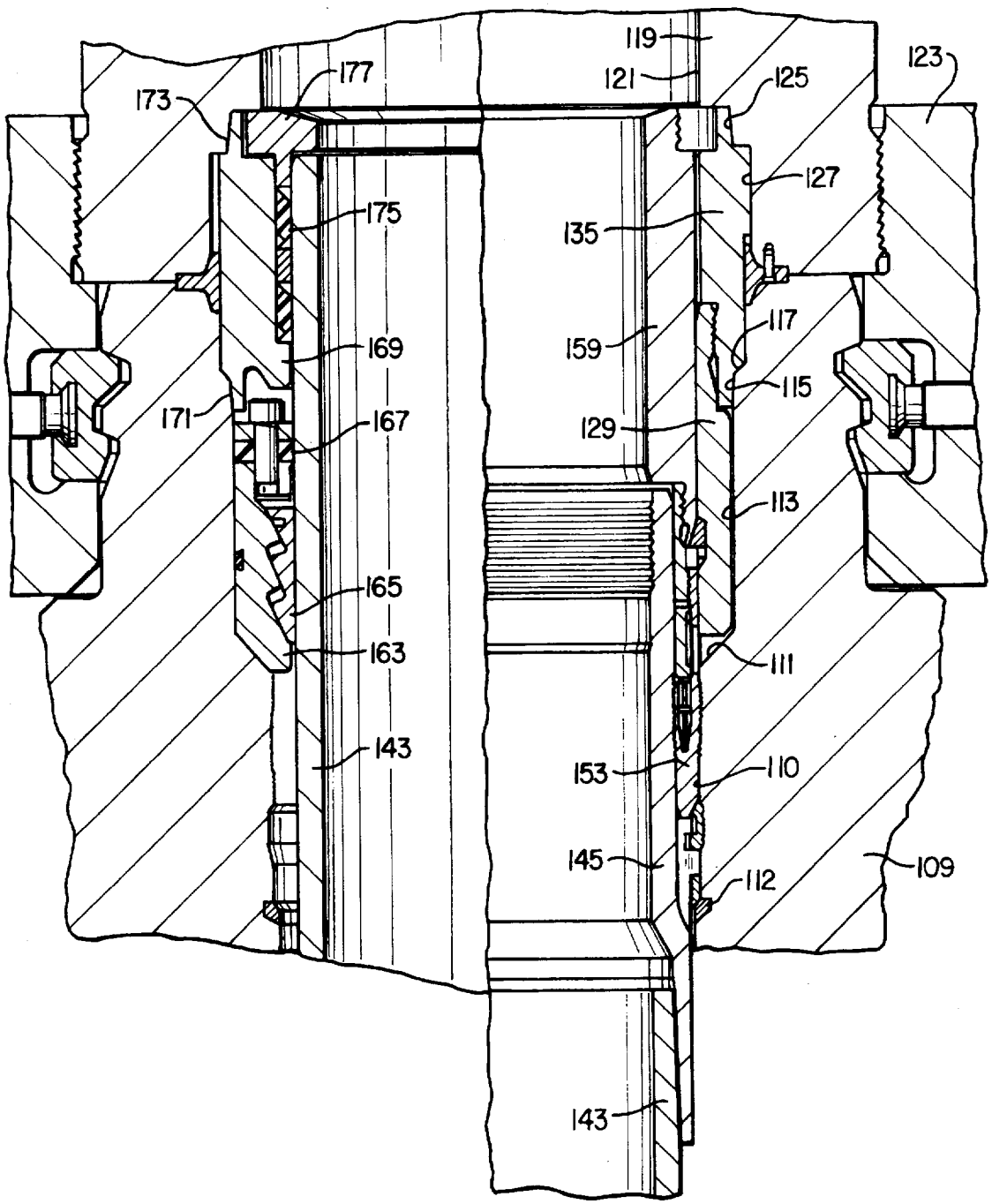
FIG. 4 is a sectional view of the wellhead assembly of FIG. 3, showing also on the left-hand side an installation for emergency conditions.

Referring to FIGS. 3 and 4, in this embodiment lower wellhead housing 109 has a bore 110 with a casing hanger landing shoulder 112. Landing shoulder 112 is shown as a separate metal ring, but it could also be an integral shoulder. An adapter shoulder 111 is located at the lower end of an enlarged counterbore area 113. There is no seal area below adapter shoulder 111, unlike seal area 19 of FIG. 1. There is a seal surface 115 within counterbore 113. Seal surface 115 tapers in the same manner as seal surface 23 (FIG. 1), and leads to a landing shoulder 117.

An upper wellhead housing 119 secures to the upper end of lower wellhead housing 109 in a similar manner as in the first embodiment. Upper wellhead housing 119 has a bore 121, and a connector 123 connects the wellhead housings 109, 119 together. An upper wellhead seal surface 125 is formed at the upper end of a counterbore 127 in upper wellhead housing 119.

An adapter sleeve 129 locates within counterbore 113 and also protrudes into counterbore 127. In this embodiment, adapter sleeve 129 is of two pieces rather than one piece. A locking groove 131 is located in the inner diameter of the lower portion of adapter sleeve 129, as shown in FIG. 3. Threads 133 connect the lower portion to an upper extension member 135. Upper extension member 135 extends through the upper portion of counterbore 113 above shoulder 117 and into counterbore 127. Upper extension member 135 has a landing shoulder 137 that lands on shoulder 117 formed in lower wellhead housing 109. A lower seal 139 on upper extension member 135 sealingly engages seal surface 115. An upper seal 141 integrally formed on the upper end of upper extension member 135 sealingly engages seal surface 125.

A string of casing 143 extends into the well. In nonemergency conditions, a casing hanger 145 having an external shoulder 147 will land on shoulder 112. This differs from the first embodiment wherein casing hanger 63 lands on a landing shoulder 55 within adapter sleeve 43. Wickers 149, 151 are formed respectively on the exterior of casing hanger 145 and in the bore 110 of lower wellhead housing 109. A conventional casing hanger seal 153 seals between wickers 149, 151 below adapter shoulder 111. Seal 153 also locks casing hanger 145 in place by pushing outward a lock ring 155 into a groove in bore 110 as seal 153 is lowered in place. An energizing ring 157 is used to set the seal 153. A reacting ring 159 on the upper end of energizing ring 157 wedges a lock ring 161 outward into lock ring groove 131 in adapter sleeve 129.

Just as in the first embodiment, for emergency conditions, upper wellhead housing 119 is removed, then adapter sleeve 129 including its upper extension member 135. A conventional slip bowl 163 and slips 165 are installed in place as shown in FIG. 4 on the left-hand side. A seal 167 is set to seal between counterbore 113 and casing 143 in the same manner as described in connection with the first embodiment. Casing 143 is cut off, and a transition member 169 is placed on shoulder 117. It has a lower seal 171 which engages seal surface 115, while its upper seal 173 engages upper seal surface 125 when upper wellhead housing 119 is reinstalled. During the reinstallation, casing seal 175 is set by setting ring 177 in the same manner as previously described.

Figure 5:
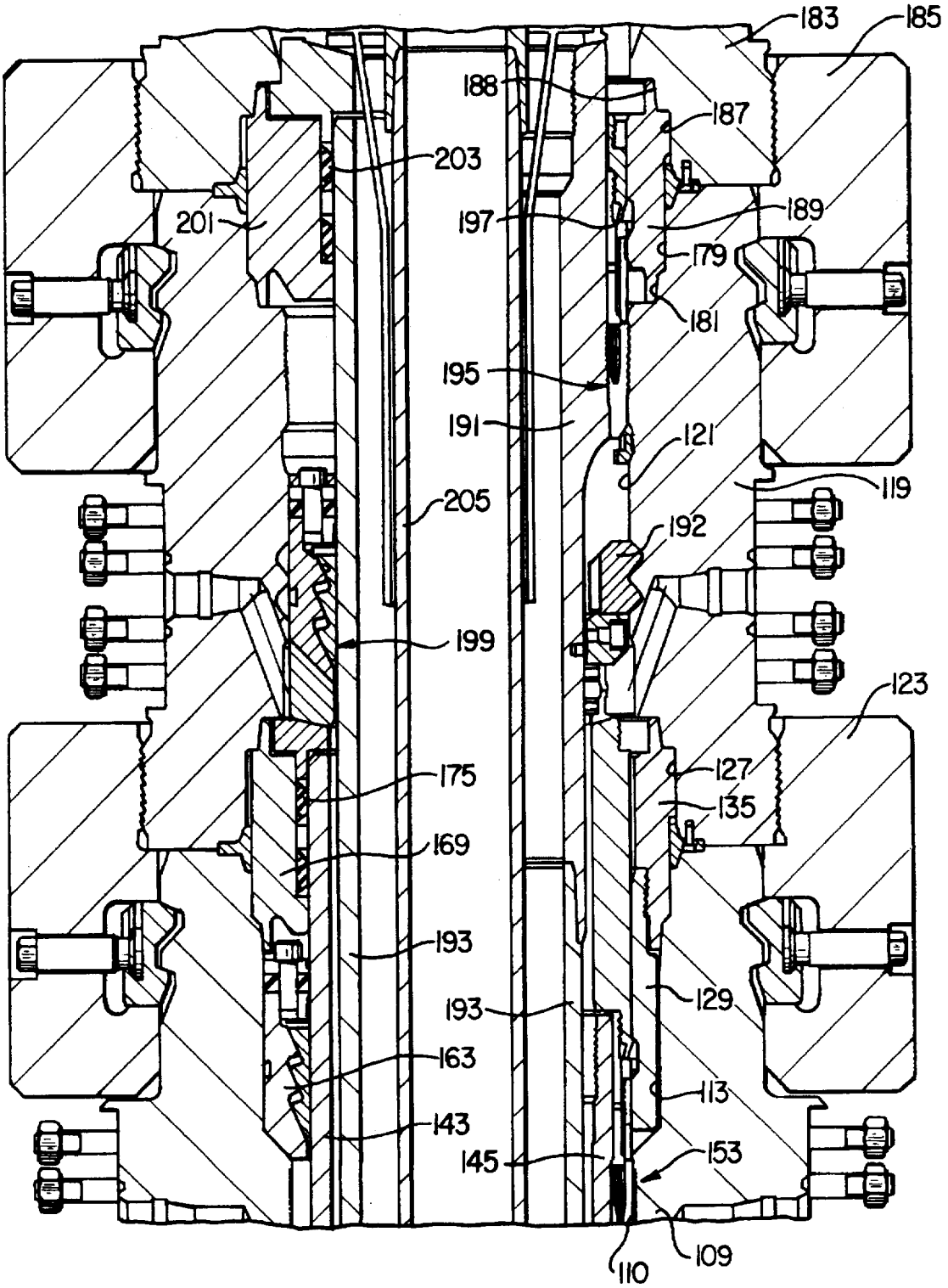
FIG. 5 is a reduced scale sectional view of the embodiment of FIG. 4, with the right-hand showing a nonemergency installation and the left-hand showing an emergency installation.

FIG. 5 shows more of the upper wellhead housing 119. Upper wellhead housing 119 has an upper counterbore 179 which extends upward from an adapter shoulder located at the upper end of a tapered seal surface 181. Upper wellhead housing bore 121 has the same diameter as the lower wellhead housing bore 110 below counterbore 113. Counterbore 179 has the same diameter as counterbore 113. A tubing head or housing 183 mounts to the upper end of upper wellhead housing 119 by a conventional connector 185. Tubing head 183 has a lower counterbore 187 which registers with counterbore 179. A seal surface 188 is located in tubing head 183.

An adapter sleeve 189 is located in the counterbores 179, 187 for nonemergency installations. Adapter sleeve 189 has integral metal seals on its lower and upper ends for sealingly engaging seal surfaces 181, 188. A casing hanger 191 has a movable load ring 192 which expands into a landing groove in upper wellhead housing 119. A string of casing 193 smaller in diameter than casing 143 is supported by casing hanger 191. A conventional seal assembly 195 seals between bore 121 of upper wellhead housing 119 and casing hanger 191 below adapter sleeve 189. Seal assembly 195 has a locking ring which expands outward into engagement with a locking groove 197 in the interior profile of adapter sleeve 189.

For emergency installations, the left-hand side of FIG. 5 shows adapter sleeve 189 removed. A slips assembly 199 is located in the bore 121 between upper wellhead housing 119 and casing 193. Because casing 193 is smaller in diameter than casing 143, and bores 110, 121 are the same, adequate room exists to place the slips assembly 199 below upper wellhead housing counterbore 179. After casing 193 is cut, a transition member 201 locates in counterbore 179 and sealingly engages the seal areas 181, 188. A casing seal 203 is set between transition member 201 and casing 193.

Subsequently, production tubing 205 is installed and supported from tubing head 183, regardless of whether the emergency or nonemergency installations are used. Although not shown, upper wellhead housing 29 of FIG. 1 will have similar features to upper wellhead housing 119, enabling it to support a string of casing under emergency and nonemergency conditions.

The invention has significant advantages. The counterbore and removable adapter sleeve allow oversize casing to be employed both for nonemergency and emergency conditions. The assembly provides dual barrier seals to atmosphere.

While the invention has been shown in only two of its forms, it should be apparent to those skilled in the art that it is not so limited, but is susceptible to various changes without departing from the scope of the invention.

I claim:

1. In a wellhead assembly having a wellhead housing which has a bore and which is located at an upper end of a string of casing extending into a well, an improved apparatus for supporting and sealing the casing comprising in combination:

an adapter sleeve in the bore of the wellhead housing, the adapter sleeve having an inner diameter which is spaced from the casing hanger and has a profile located therein;

a casing hanger seal assembly, at least a portion of the casing hanger seal assembly engaging the profile; wherein:

the casing hanger seal assembly includes a casing hanger seal, an energizing member which is moved downward to set the casing hanger seal, and a locking member for locking the energizing member in a set position; and the profile of the adapter sleeve contains a locking groove for receiving the locking member.

2. In a wellhead assembly having a wellhead housing which has a bore and which is located at an upper end of a string of casing extending into a well, an improved apparatus for supporting and sealing the casing comprising in combination:

an adapter sleeve in the bore of the wellhead housing, the adapter sleeve having an inner diameter which is spaced from the casing hanger and has a profile located therein;

a casing hanger seal assembly, at least a portion of the casing hanger seal assembly engaging the profile; and an adapter sleeve seal which seals an outer diameter portion of the adapter sleeve to the bore of the wellhead housing.

3. In a wellhead assembly having a wellhead housing which has a bore and which is located at an upper end of a string of casing extending into a well, an improved apparatus for supporting and sealing the casing comprising in combination:

an adapter sleeve in the bore of the wellhead housing, the adapter sleeve having an inner diameter which is spaced from the casing hanger and has a profile located therein;

a casing hanger seal assembly, at least a portion of the casing hanger seal assembly engaging the profile;

an upper wellhead member having a bore and which is secured to an upper end of the wellhead housing;

an upper extension portion on the adapter sleeve which protrudes above the upper end of the wellhead housing into the bore of the upper wellhead member; and an upper seal which seals the upper extension portion to the bore of the upper wellhead member.

4. A wellhead assembly, comprising in combination:

a wellhead housing having an axial bore which has an upward facing adapter shoulder, defining an enlarged diameter counterbore extending upward from the adapter shoulder;

a string of casing extending from the wellhead housing into the well;

a casing hanger which secures to the upper end of the string of casing for supporting the casing in the wellhead housing;

an adapter sleeve in the counterbore, extending upward from the adapter shoulder and having an inner diameter which is radially spaced from the casing hanger;

a locking groove in the inner diameter of the adapter sleeve;

an adapter sleeve seal which seals an outer diameter portion of the adapter sleeve to the bore of the wellhead housing;

a casing hanger seal which seals an annulus surrounding the casing;

an energizing member which is moved downward to set the casing hanger seal; and a locking member carried above the casing hanger seal for locking the energizing member in a set position, the locking member locating in the profile in the adapter sleeve.

5. The wellhead assembly according to claim 4 further comprising:

an internal landing shoulder formed in the inner diameter of the adapter sleeve; and an external landing shoulder on the casing hanger which lands on the internal landing shoulder.

6. The wellhead assembly according to claim 4, further comprising:

an upper wellhead member having a bore and which is secured to an upper end of the wellhead housing;

an upper extension portion on the adapter sleeve which protrudes above the upper end of the wellhead housing into the bore of the upper wellhead member; and an upper seal which seals the upper extension portion to the bore of the upper wellhead member.

7. The wellhead member according to claim 4 wherein the casing hanger seal locates between and sealingly engages the casing hanger and the adapter sleeve.

8. The wellhead member according to claim 4 wherein the casing hanger seal locates between and sealingly engages the casing hanger and the bore of the wellhead housing below the adapter sleeve.

9. The wellhead member according to claim 4 wherein the adapter sleeve seal seals to the bore of the wellhead housing at a point below the adapter shoulder.

10. The wellhead member according to claim 4 wherein the adapter sleeve seal seals to the bore of the wellhead housing at a point above the adapter shoulder.

11. A wellhead assembly, comprising in combination:

a wellhead housing having a bore which has an upward facing adapter shoulder, defining an enlarged diameter counterbore extending upward from the adapter shoulder;

a tapered seal area formed in the bore below the adapter shoulder;

a string of casing extending from the wellhead housing into the well;

a casing hanger which secures to the upper end of the string of casing for supporting the casing in the wellhead housing;

an adapter sleeve located in the counterbore, the adapter sleeve extending upward from the adapter shoulder and having an inner diameter which is spaced radially from the casing hanger, defining an annular space;

an integral tapered seal member formed on a lower end of the adapter sleeve which sealingly engages the tapered seal area;

an internal landing shoulder formed in the inner diameter of the adapter sleeve, the casing hanger landing on the internal landing shoulder; and a casing hanger seal assembly located in the annular space and sealingly engaging the adapter sleeve and the casing hanger.

12. The wellhead assembly according to claim 11, further comprising:

an upper wellhead member having a bore and which is secured to an upper end of the wellhead housing;

an upper extension portion on the adapter sleeve which protrudes above the upper end of the wellhead housing into the bore of the upper wellhead member; and an upper seal which seals the upper extension portion to the bore of the upper wellhead member.

13. The wellhead assembly according to claim 11 further comprising:

a set of wickers formed in the inner diameter of the adapter sleeve; and a set of wickers formed on the outer diameter of the casing hanger adjacent to the adapter sleeve; wherein the casing hanger seal assembly seals against the set of wickers.

14. The wellhead assembly according to claim 11 wherein:

the casing hanger seal assembly includes a casing hanger seal, an energizing member which is moved downward to set the casing hanger seal, and a locking member for locking the energizing member in a set position;

the inner diameter of the adapter sleeve contains a locking groove which receives the locking member; and the casing hanger seal sealingly engages the adapter sleeve and the casing hanger below the locking groove.

15. A wellhead assembly, comprising in combination:

a wellhead housing having a bore which has an upward facing adapter shoulder, defining an enlarged diameter counterbore extending upward from the adapter shoulder;

a string of casing extending from the wellhead housing into the well;

a casing hanger which secures to the upper end of the string of casing for supporting the casing in the wellhead housing;

an adapter sleeve which is placed in the counterbore, the adapter sleeve extending upward from the adapter shoulder and having an inner diameter which is spaced radially from the casing hanger, defining an annular space, the inner diameter of the adapter sleeve having a locking groove;

a casing hanger seal which is sealingly located between and sealingly engages the bore of the wellhead housing and the casing hanger below the adapter sleeve; and an energizing member which is moved downward to set the casing hanger seal, and a locking member for locking the energizing member in a set position, the locking member locating in the locking groove.

16. The wellhead assembly according to claim 15, further comprising:

an upper wellhead member having a bore and which is secured to an upper end of the wellhead housing;

an upper extension member forming a part of the adapter sleeve, the upper extension member protruding above the upper end of the wellhead housing into the bore of the upper wellhead member; and an upper seal which seals the upper extension member to the bore of the upper wellhead member.

17. The wellhead assembly according to claim 15, further comprising:

a tapered seal area formed in the bore of the wellhead housing above the adapter shoulder;

an upper wellhead member having a bore and which is secured to an upper end of the wellhead housing;

an upper extension member secured to and forming a part of the adapter sleeve, the upper extension member protruding above the upper end of the wellhead housing into the bore of the upper wellhead member;

a tapered seal member formed on a lower end of the upper extension member which sealingly engages the tapered seal area;

an upper seal which seals the upper extension member to the bore of the upper wellhead member.

18. In a wellhead assembly having a string of casing extending into a well, a lower wellhead housing at the upper end of the string of casing and having an upper end face, an upper wellhead housing having a lower end face which abuts the upper end face of the lower wellhead housing, each of the wellhead housings having a bore, an abutment seal located at the abutment of the end faces, the lower wellhead housing containing a load shoulder within its bore, an improved apparatus for supporting and sealing the casing, the apparatus comprising in combination:

a casing suspension means located within the bore of the lower wellhead housing and in engagement with the casing for supporting the casing on the load shoulder;

casing seal means located within the bore of the lower wellhead housing for sealing an annulus surrounding the casing to the lower wellhead housing;

a tubular extension member extending into the bore of the lower wellhead housing and protruding above the end face of the lower wellhead housing into the bore of the upper wellhead housing;

a lower seal on the extension member which seals the tubular member to the bore of the lower wellhead housing below the abutment seal; and an upper seal on the extension member which seals the extension member to the bore of the upper wellhead housing above the abutment seal.

19. The wellhead assembly according to claim 18, wherein:

the bores of the upper and lower wellhead housings have tapered seal areas;

the lower seal comprises a tapered metal surface; and the upper seal comprises a tapered metal surface.

20. A method of supporting and sealing a string of casing within a well having a wellhead housing which has a bore, comprising:

providing an enlarged diameter counterbore in the bore of the wellhead housing;

installing an adapter sleeve in the counterbore, and providing the adapter sleeve with an inner profile;

sealing an outer diameter portion of the adapter sleeve to the bore of the wellhead housing;

securing a casing hanger to an upper end of the string of casing, lowering the casing into the well and landing the casing hanger in the wellhead housing; and installing a casing hanger seal assembly around the casing hanger by locating at least a portion of the casing hanger seal assembly in the profile of the adapter sleeve.

21. The method according to claim 20 wherein the step of landing the casing hanger comprises:

providing a landing shoulder in the adapter sleeve and landing the casing hanger on the landing shoulder.

22. The method according to claim 20 wherein the step of landing the casing hanger comprises:

providing a landing shoulder in the bore of the wellhead housing below the adapter sleeve and landing the casing hanger on the landing shoulder.

23. The method according to claim 20 wherein the step of installing the casing hanger seal assembly comprises:

setting a casing hanger seal of the casing hanger seal assembly between the adapter sleeve and the casing hanger.

24. The method according to claim 20 wherein the step of installing the casing hanger seal assembly comprises:

setting a casing hanger seal of the casing hanger seal assembly between the bore of the wellhead housing and the casing hanger below the adapter sleeve; and locking the casing hanger seal in a set position by engaging the inner profile of the adapter sleeve with a locking member.

25. A method of supporting and sealing a string of casing within a well having a wellhead housing which has a bore, comprising:

providing an enlarged diameter counterbore in the bore of the wellhead housing;

installing an adapter sleeve in the counterbore, and providing the adapter sleeve with an inner profile;

securing a casing hanger to an upper end of the string of casing, lowering the casing into the well and landing the casing hanger in the wellhead housing;

installing a casing hanger seal assembly around the casing hanger by locating at least a portion of the casing hanger seal assembly in the profile of the adapter sleeve;

securing an upper wellhead member having a bore to an upper end of the wellhead housing; and extending an upper extension portion on the adapter sleeve above the upper end of the wellhead housing sealingly into the bore of the upper wellhead member.

* * * * *